United States Patent [19]

Mis

[11] Patent Number: 4,598,434

[45] Date of Patent: Jul. 8, 1986

[54] FOLDING LEG SUPPORT FOR METAL BED

[76] Inventor: Frank J. Mis, 9601 S. Robertson, Oak Lawn, Ill. 60453

[21] Appl. No.: 615,569

[22] Filed: May 31, 1984

[51] Int. Cl.[4] ..... A47C 19/00

[52] U.S. Cl. ..... 5/200 R; 5/202; 5/312; 5/316

[58] Field of Search ..... 5/311, 312, 313, 314, 5/114, 111, 316, 201, 202, 200 R, 203

[56] References Cited

U.S. PATENT DOCUMENTS

| | | | |
|---|---|---|---|
| 580,543 | 4/1897 | Bradford | 5/316 |
| 1,419,765 | 6/1922 | Schilling | 5/316 |
| 1,813,019 | 7/1931 | Brown | 5/114 |
| 3,789,437 | 2/1974 | Garte | 5/114 |

*Primary Examiner*—Alexander Grosz

*Attorney, Agent, or Firm*—John J. Kowalik

[57] ABSTRACT

A metal bed having a frame with side and end members and transverse beams connected to the side members, two of these beams being larger and stronger than the others and being located adjacent to opposite ends of the frame and serving as leg-support beams and providing pockets into which the attached leg assemblies are adapted to be folded for shipment or storage, the leg assemblies being unfoldable to upright frame-supporting position. Various embodiments of leg assemblies are disclosed.

6 Claims, 23 Drawing Figures

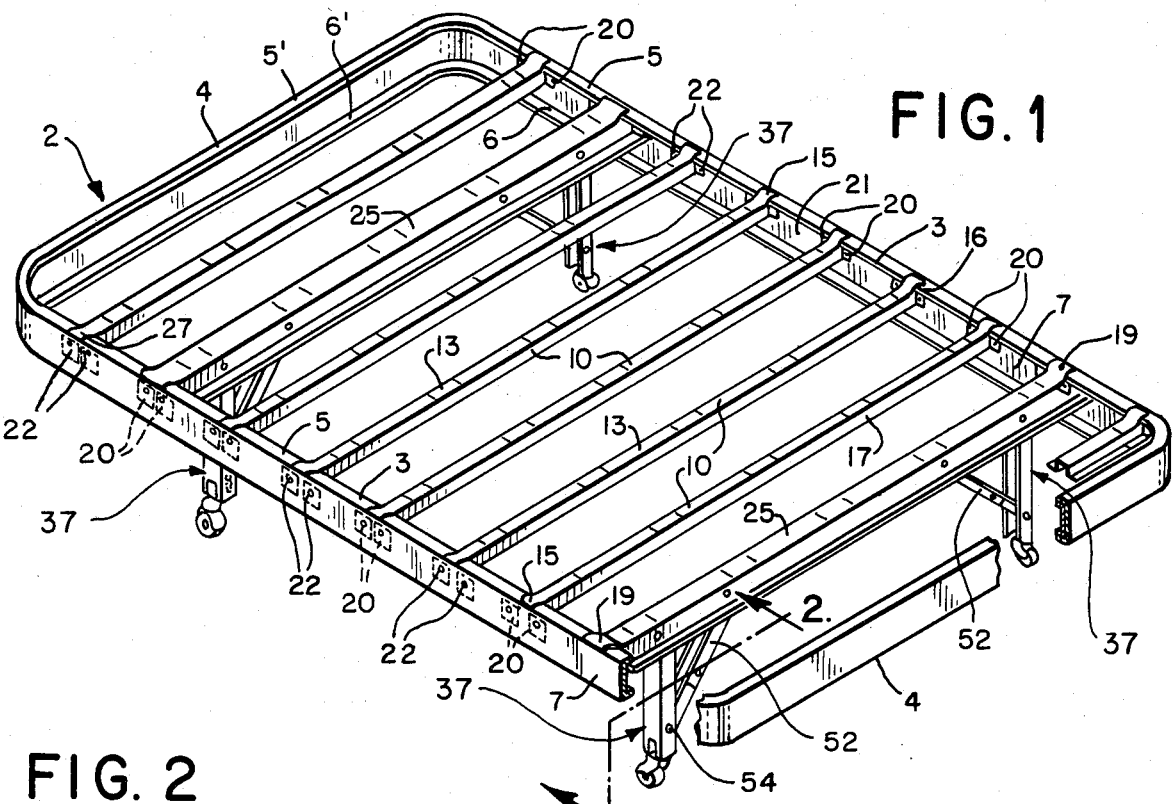
FIG. 1
FIG. 2
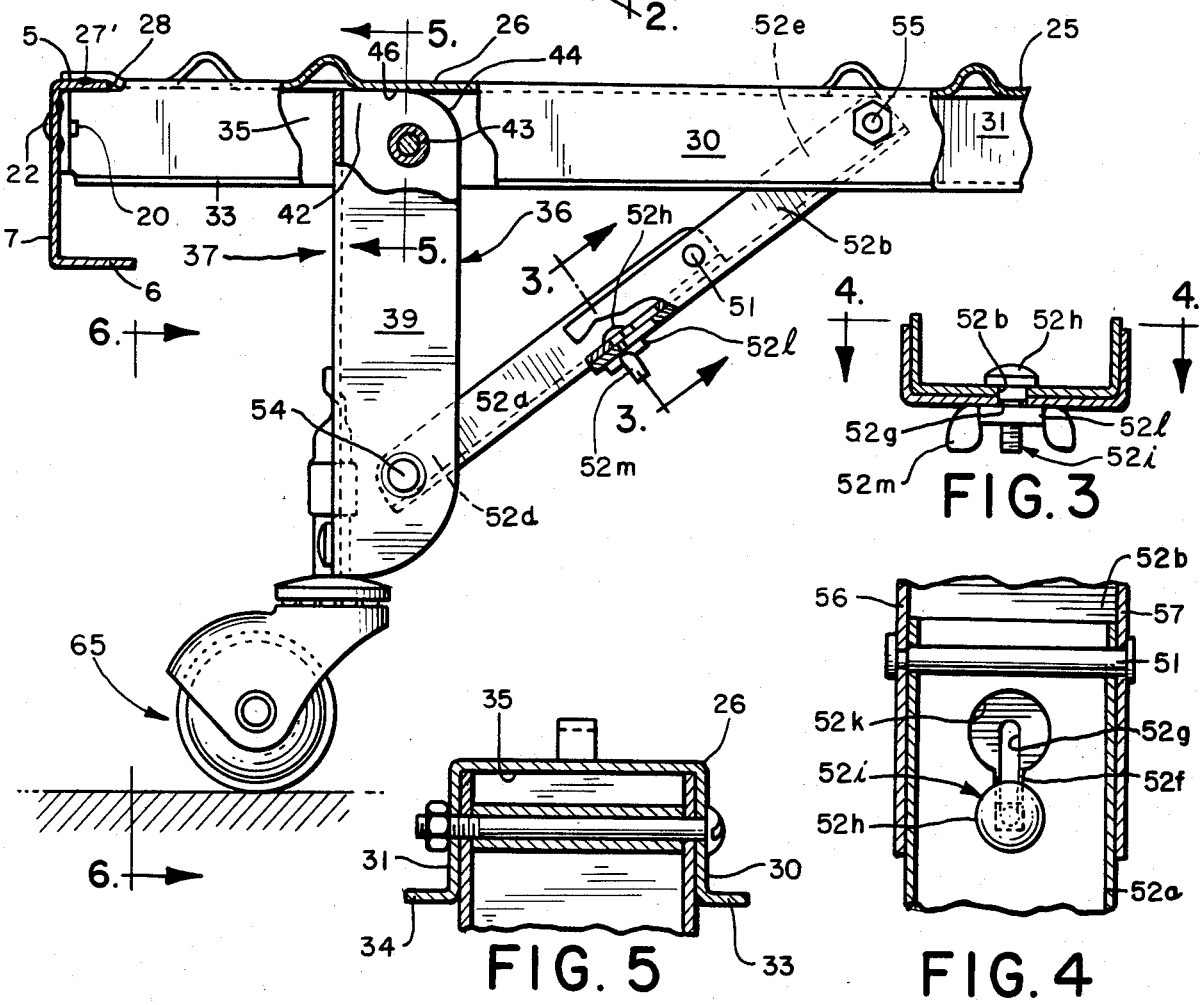
FIG. 3
FIG. 5
FIG. 4

FIG. 11
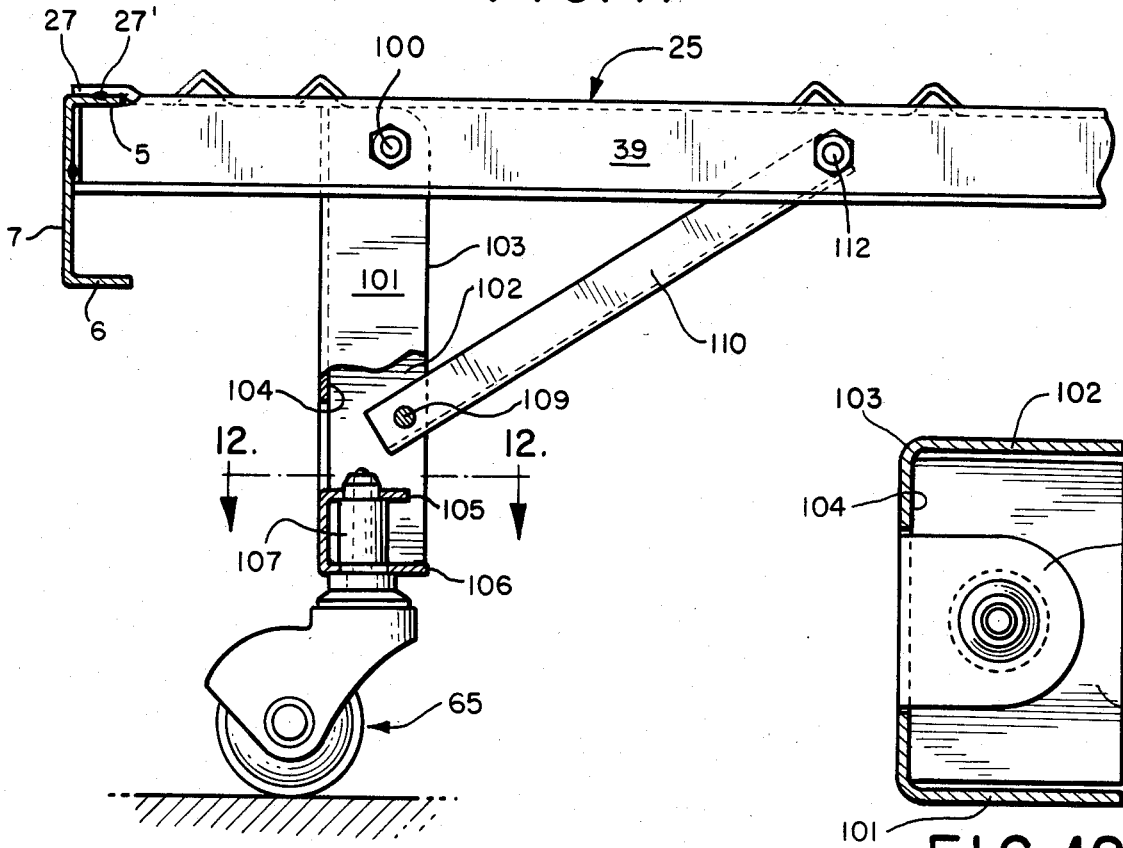
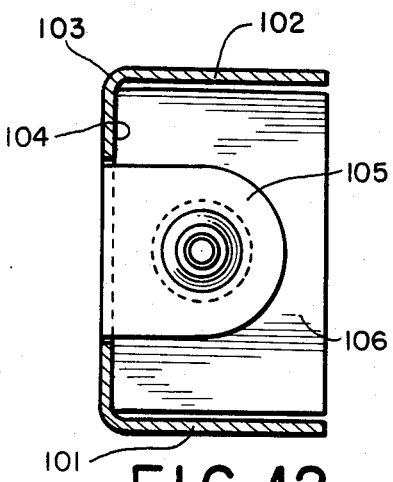
FIG. 12
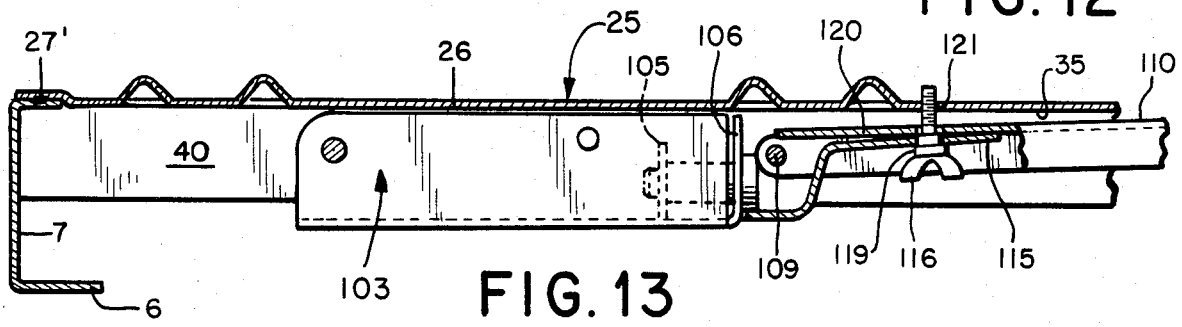
FIG. 13
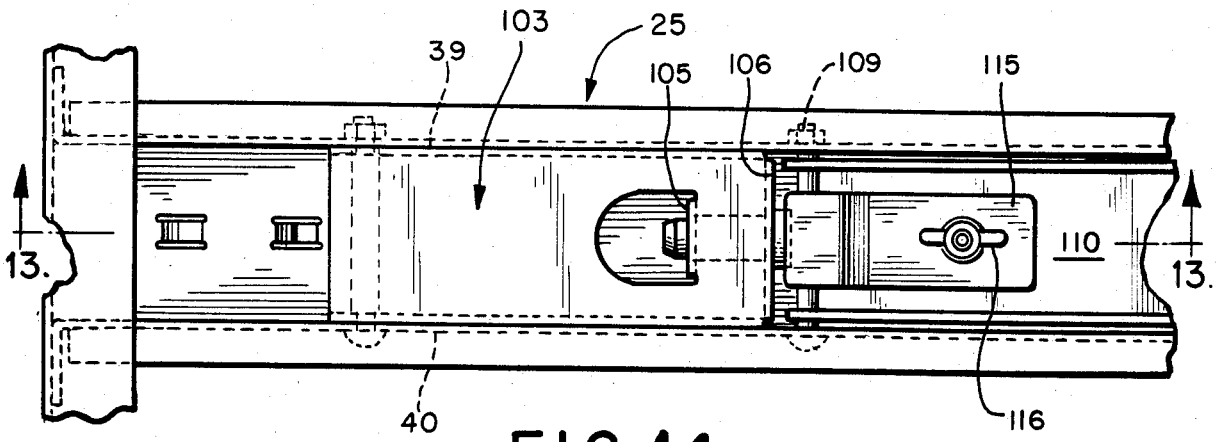
FIG. 14

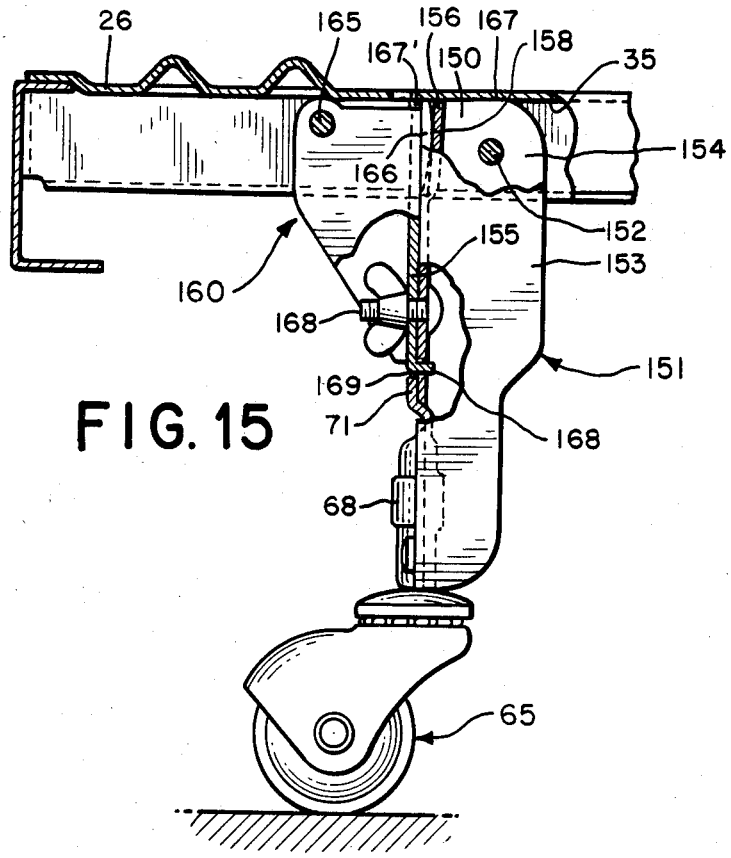
FIG. 15
FIG. 16
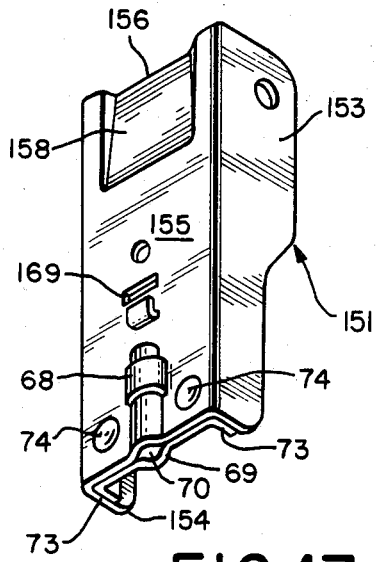
FIG. 17
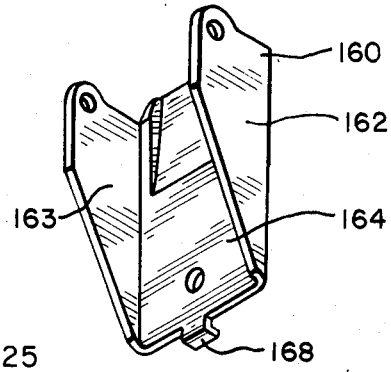
FIG. 18
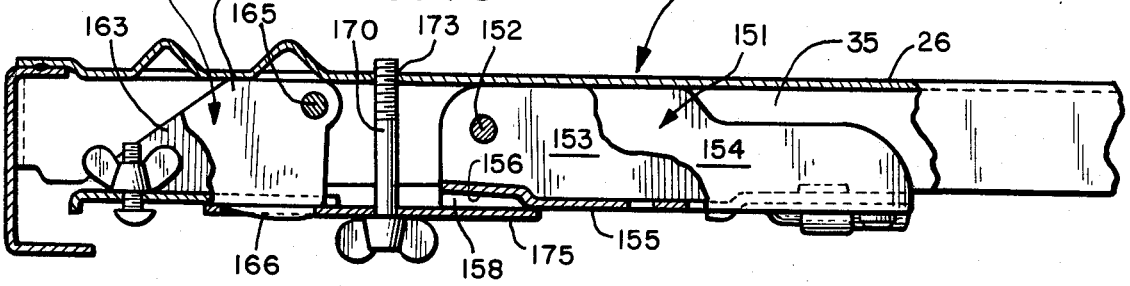
FIG. 19
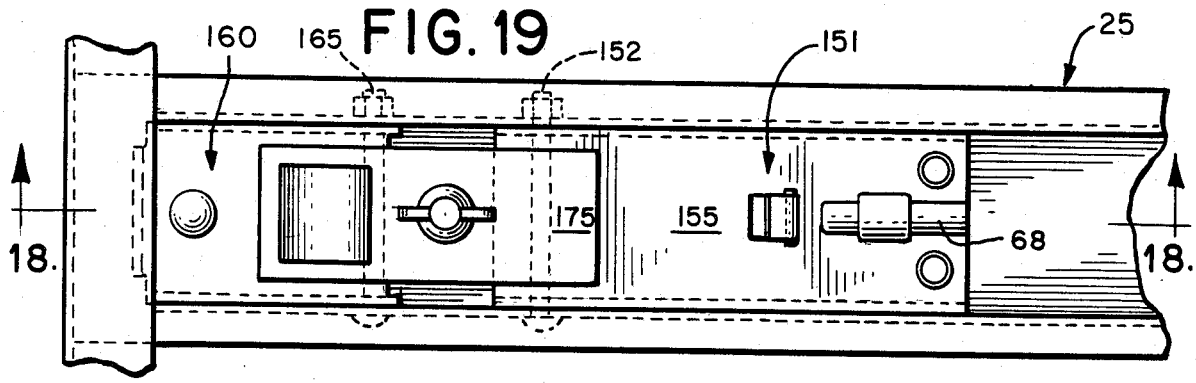

FOLDING LEG SUPPORT FOR METAL BED

BACKGROUND OF THE INVENTION

This invention relates to beds and more particularly to a bed wherein the spring frame and bed frame are integrated into a unitary structure and wherein the frame is supported by foldable legs so that the entire assembly may be shipped or stored as a unit.

DISCUSSION OF THE PRIOR ART

Heretofore it has been a common practice to provide separate bed frame and bed spring assemblies called box springs, the frame supporting the box spring and two supporting a matress. These three units were handled and sold separately thus necessitating three separate packages. The bed frame normally consisted of a pair of side rails and interconnecting cross members which were secured in various ways to the side rails. Legs were secured to the side rails and sliders or wheels were secured to the lower ends of the legs.

The conventional bed spring assembly consists of a rectangular framing comprising a pair of wooden side members and a pair of wooden end members which are interconnected with the side members. The springs are nested within the frame and are tied together with cord and wire and to a series of wooden cross-members to which the springs are stapled. One of the more frequently reoccuring problems is that good lumber is becoming scarce which increases its cost and availability.

SUMMARY OF THE INVENTION

In order to eliminate the necessity of providing a separate bed frame and bed spring assembly, it is an object of this invention to provide a novel basic frame construction wherein all of the parts are made of metal, preferably steel, and in which the parts are made to interfit with one another so as to strengthen each other and to facilitate connection of the pieces preferably by welding, and wherein certain of these members are formed to provide novel means for attachment of support legs wherein such certain members are formed to accommodate folding of the legs thereinto to make the structure compact and thus facilitate boxing and storing.

The invention contemplates providing a basic frame which may serve as a combination bed frame and box spring frame.

A further object is to provide a novel frame which can be use with various types of folding legs.

Another object of the invention is to provide a basic frame which may be optionally provided with either leg mounting beams or in the same location with spring mounting cross members so as to produce a combined bed frame and bed spring assembly or only a box spring. Thus one component serves as a basic structure for either assembly.

These and other objects and advantages of the invention will become more readily apparent from the specification and the drawings, wherein:

FIG. 1 is a fragmentary broken apart perspective view of my novel structure illustrated as an assembly of a spring and bed frame mode;

FIG. 2 is an enlarged sectional view taken substantially on line 2—2 of FIG. 1;

FIG. 3 is a cross-section taken substantially on line 3—3 of FIG. 2;

FIG. 4 is a bottom view of a portion of a leg strut taken generally on line 4—4 of FIG. 3;

Figure 6:
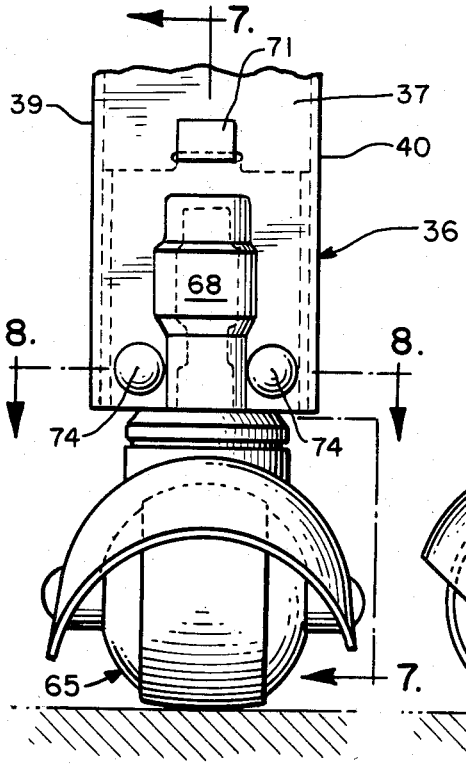
Figure 7:
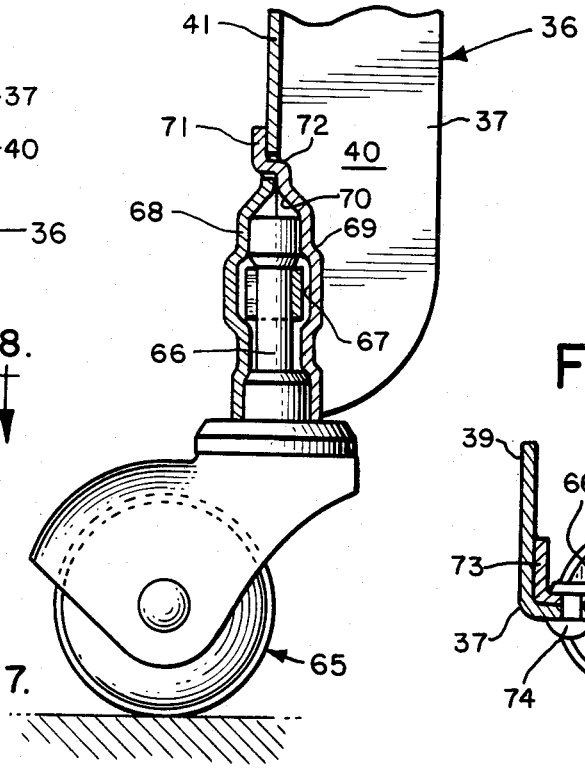
Figure 8:
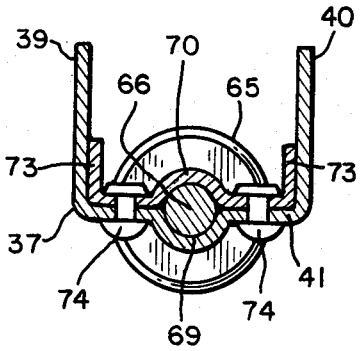
Figure 9:
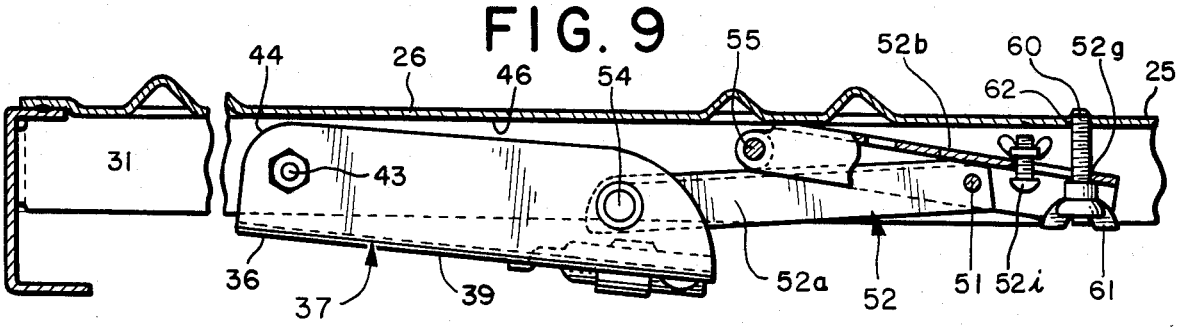
Figure 10:
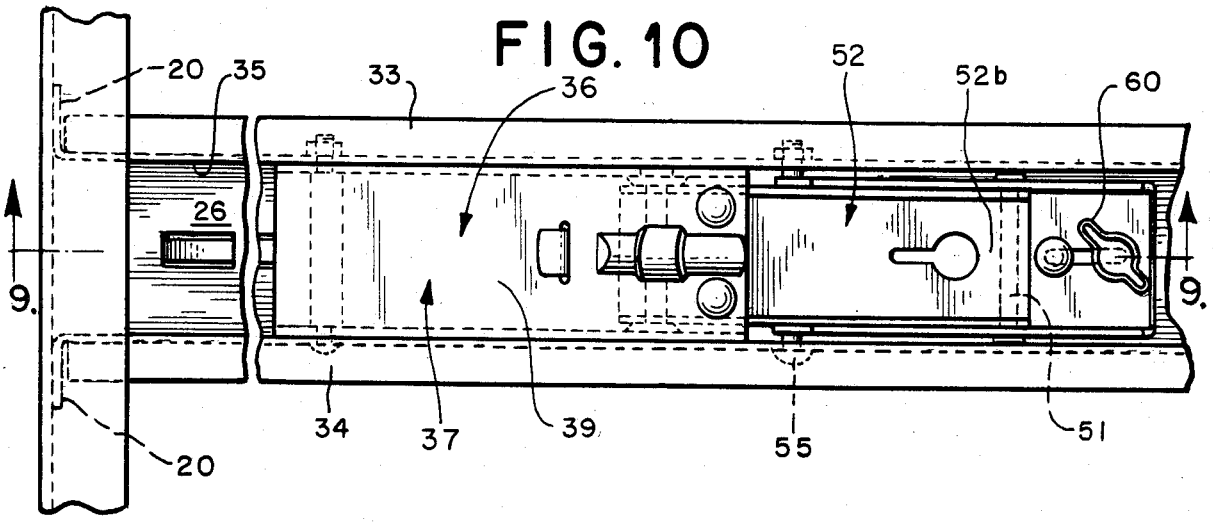

FIG. 5 a vertical sectional view taken substantially on line 5—5 of FIG. 2;

FIG. 6 a fragmentary side elevational view taken generally on line 6—6 of FIG. 2; FIG. 7 cross-sectional view taken substantially on line 7—7 of FIG. 6; and FIG. 8 a cross-section taken substantially an line 8—8 of FIG. 6;

FIGS. 9 and 10 illustrate the folded position of the leg:

FIG. 9 being a section taken substantially on the line 9—9 of FIG. 10, the leg assembly being shown in side elevation with the caster wheel removed; and FIG. 10 being a bottom view of the structure shown in FIG. 9;

FIGS. 11–14 illustrate another form of leg assembly;

FIG. 11 being a side elevational view of the leg structure and the frame portions being shown partly in section;

FIG. 12 being in section taken substantially on line 12—12 of FIG. 11;

FIG. 13 being partly in section taken on line 13—13 of FIG. 14; and

Figure 20:
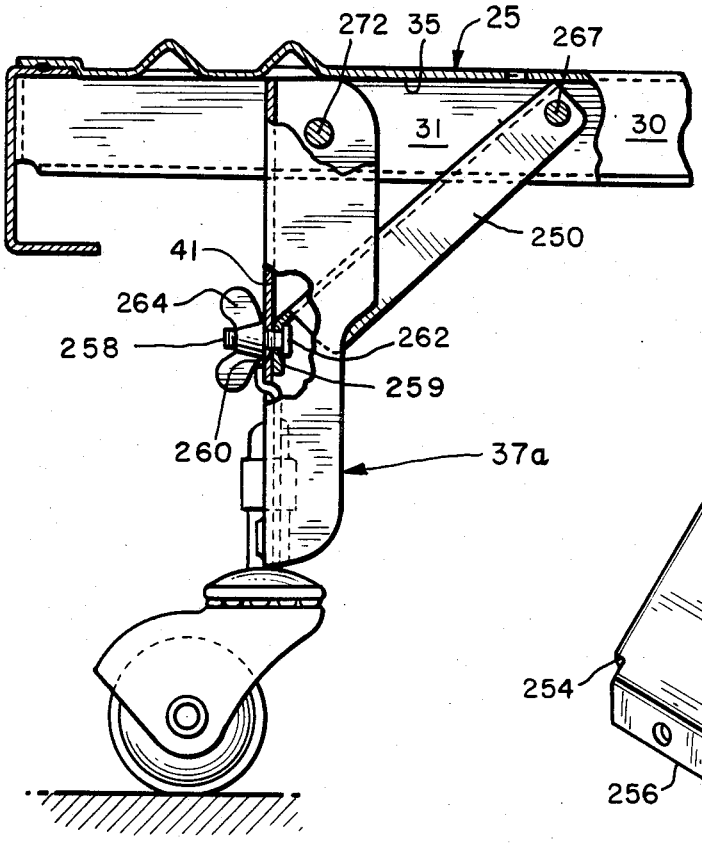
Figure 21:
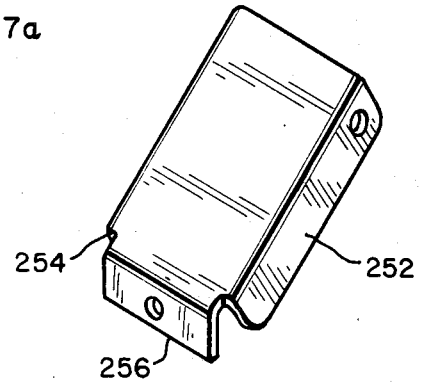
Figure 22:
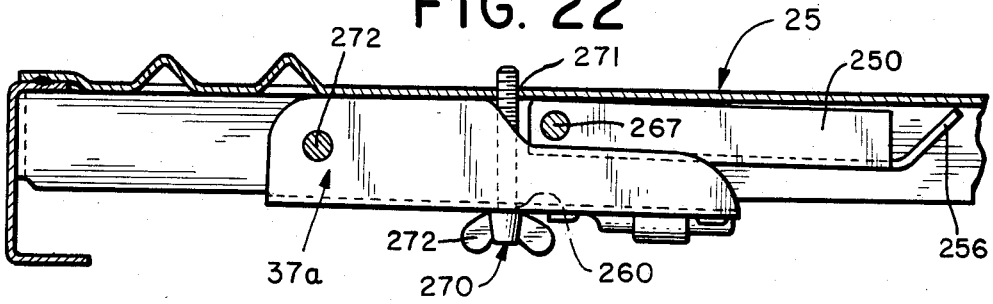
Figure 23:
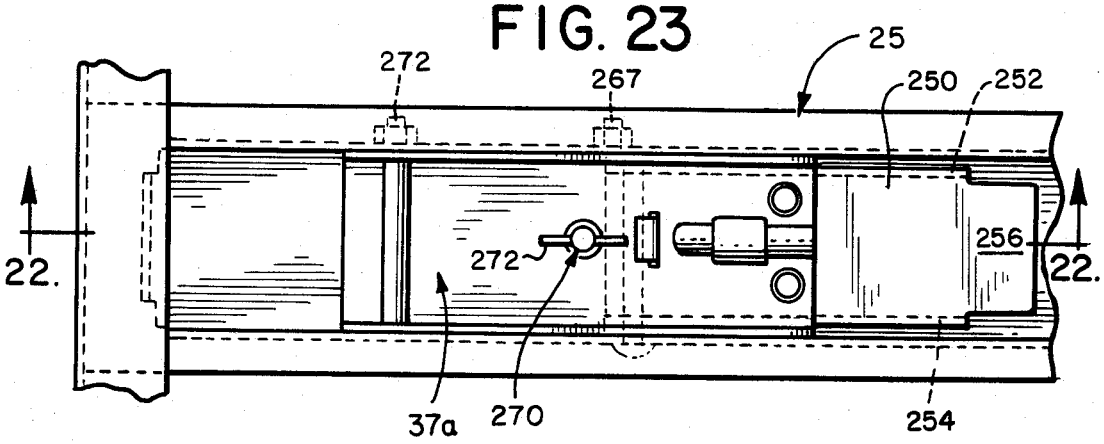

FIG. 14 being a bottom view of the structure shown in FIG. 13;

FIGS. 15–19 illustrate a further embodiment of a folding leg structure;

FIG. 15 being a side elevational view of the leg structure in extended position partly in vertical section;

FIG. 16 being perspective view of one part thereof;

FIG. 17 being another perspective view of another part thereof;

FIG. 18 being a side elevational view of the leg structure shown in folded position, and the view being partly in section taken substantially on line 18—18 of FIG. 19; and FIG. 19 being a bottom view of the structure shown in FIG. 18;

FIGS. 20–23 illustrate a further embodiment of the invention;

FIG. 20 being a side elevational view of the leg assembly partly shown in section with the frame;

FIG. 21 being a perspective view of the stabilizing brace of the leg assembly;

FIG. 22 being a side elevational view of the leg assembly shown in FIG. 20 with the wheel removed and partly in section taken on line 22—22 of FIG. 23 and FIG. 23 being a bottom view of the structure shown in FIG. 22.

DESCRIPTION OF FIGS. 1–10

Describing the invention in detail, and having particular reference to FIGS. 1–8 the basic steel frame, generally designated 2 comprises a rectangular structure having a pair of side rails or members 3,3 and end members 4,4 at opposite ends interconnecting the side members 3,3.

The side and end members are channel shape and have top and bottom webs or flanges 5,6 and 5′,6′ and integral vertical webs or walls 7,7′ respectively. For purposes of this application the end members may be suitably weld-connected to the side members in any known manner. However, an important aspect of the invention is in the provision of a plurality of parallel U-shaped or channel spring support cross-members 10,10 which are of relatively narrow width. The top wall 13 of each member 10 is cut at each end and is upwardly offset forming a tab 15 and a horizontal slot 16 therebelow with the upper edges of the vertical walls 17,17 of the beam member 10. The slot 16 admits a top flange 5 of the related side rail 3 and the tab 15 is preferably welded thereto at 19, 19. The vertical walls 17 are each formed with an outturned tab 20 at each end and the tabs seat against the interior side 21 of the respective wall 7 and is welded as at 22 thereto.

Adjacent to each end of the basic frame there is provided a wide and deep leg support or mounting channel shaped beam 25 also having a top wall 26 coplanar with the top walls 13 of the spring mounting beams. Each beam 25 is U-shaped and the top wall 26 is cut at each end and upwardly offset to form tabs 27,27 each defining a horizontal slot 28 with the upper edges of the upright side walls 30,31. The slots 28 admit the horizontal webs 5 of the respective side rails therein and the tabs 27 overlap the webs 5 and are weld-connected thereto as at 27'. The bottom edges of the walls 30,31 are integrally formed with outturned horizontal flanges 33,34 to provide additional strength.

The beams 25 provide downwardly open pockets 35 into each end of which, spaced inwardly of the side rails, there are fitted a pair of folding leg assemblied 36,36.

Each leg assembly has a leg member generally designated 37, which is positioned upright in extended bed-supporting position and comprises a U-shaped channel including a pair of side webs 39,40 and an intervening web 41. The upper end 42 of the channel is fitted into the pocket 35 and is pivoted on a horizontal axis by a bolt and nut assembly 43 extending through the webs 39,40 through aligned apertures therein and apertures in the paralleling flanking side webs 30,31. The upper corners of the side webs 39,40 are rounded at 44 to allow the pivoting. The upper edge portions of the webs 39,40 are flat and seat flat against the flat bottom side 46 of the top web 26 to provide a stable non-rocking seat for the leg. A reinforcing spacer sleeve is inserted on the bolt 43 between the webs 39,40.

A folding diagonal brace, strut or stabilizing means generally designated 52 extends between the lower end 50 of the leg and a portion of the leg support beam 25 spaced laterally inwardly of the leg. The brace comrises a pair of lengths, portions or segments 52*a* and 52*b* which are channel shape and overlap or telescope at adjacent ends one within the other and are pivotally connected with each other by a horizontal pin or bolt and nut assembly 51. The lower end 52*d* of the lower link is pivoted by a pin 54 to the lower ends of the side webs 39,40 of the leg and the upper end 52*e* is pivoted by a horizontal pin 55 extending through the webs 30,31 and side webs 56,57 of the channel shaped upper link.

It will be noted that the lower link 52*a* is narrower than the upper link 52*b* and that the pivot 51 of link 52*a* is located at its upper end and that the pivot 51 of the upper link 52*b* is positioned intermediate its ends. Thus in the upright position of the leg 37 as seen in FIG. 2, the slots 52*f* and 52*g* formed in the parts 52*a*, 52*b* respectively, are aligned. Slot 52*f* is key-hole shaped to permit the head 52*h* of the carriage bolt 52*i* to pass through the circular portion 52*k* of slot 52*f* to disengage the bolt 52*i* from the link portion 52*a* of the strut 52. In the secured position as seen in FIGS. 2,3 and 4 the bolt 52*i* is slid downwardly along the elongated lengths of the slots 52*g* and 52*f*.

Thus if the leg is to be folded from its upright position shown in FIG. 2 the wing nut 52*l* is loosened on the shank 52*m* of bolt 52*i* and the loosened bolt is slid upwardly until the head 52*h* enters portion 52*k*. The head drops down and the portions 52*a* and 52*b* are initially pivoted upwardly about the pin 51 thus swinging the leg 37 upwardly and the leg and link parts assume the position shown in FIGS. 9 and 10, within the pocket of the associated beam 25. Thereafter a threaded shank 60 of wing bolt 61 is inserted through slot 52*g* in strut piece 52*b* and is threaded into a threaded hole 62 in the top wall 25 so that the wing nut bears against the underside of part 52*b*, thus securing the leg assembly within pocket 35. To position upright, the leg 36 is pulled down and the links 52*a* and 52*b* unfold and are secured together by bolt 52*i* as seen in FIG. 2.

The lower end of each leg member 37 is provided with a caster wheel assembly 65 which has a vertical spindle 66 held securely within a vertical swivel bore 67 partly formed by offsetting a portion 68 of the wall or web 41 of leg 37 and partly by an opposing clamp 69 which has a complementary offset bore portion 70 in its central body portion. The clamp 69 has a hook or tang 71 at its upper end which extends through an opening 72 in the wall 41 of the offset portion and engages the external side of wall 41. The clamp has a pair of ears 73,73 at opposite sides of its body secured by rivets 74 to wall 41 against the inner side thereof.

DESCRIPTION OF FIGS. 11–14

In this embodiment parts which are identical with those of the previous embodiment will be identified by the same reference numerals.

The leg support or mounting beam 25 has its side webs 39,40 secured by a pin or bolt and nut assembly 100 to the side webs 101,102 of the channel shaped leg 103 which also has a transverse web 104. The assembly or pin passes through aligned transverse openings in the webs of the beam 25 and leg 103.

Intermediate its ends the web 104 is cut out to form a lug 105 which is bent parallel to a lug 106 formed from an extension of the lower end of web 104. These two lugs are vertically apertured and mount a spindle sleeve 107 for mounting the spindle 66 of a caster wheel assembly 65.

The leg 103 is connected pivotally intermediate its ends by a pin 109 to the lower end of a rigid diagonal brace 110 which at its upper end extends into the pocket 35 of the beam 25, and is pivotally connected to its side webs by a pin 112.

FIG. 11 shows the leg 103 in support position. In order to fold the leg 103 ,the nut and bolt assembly 100 is removed. The leg 103 is swung upwardly into the pocket 35. The brace 110 is swung about the pin 112 into the pocket as shown in FIG. 12 and then a clip 115 is place beneath the spindle sleeve 107, the caster wheel having been previously removed, and the adjacent end of the brace thus straddling the same. A wing bolt 116 is passed through an aperture 119 in a transverse wall 120 of the channel shaped brace and is threaded into an opening 121 in the web 26 of the leg mounting channel beam 25. It will be noted that the securing clip is S-shaped and is tucked into the channel brace 110 and that the leg and brace both fit into the pocket 35. To reassemble the bolt 116 is removed and the leg and brace reattached at 109 and the clip is reassembled with the web 26 for future use when the leg assembly is folded.

DESCRIPTION OF FIGS. 15–19

In this embodiment parts similar or identical to those of the previous embodiments will be identified by the same reference numerals.

The beam 25 has its side webs pivotally connected to the upper end 150 of a channel shaped leg 151 by a pin or nut and bolt assembly 152 extending through the side webs 153,154 of the leg. The upper end of the transverse web 155 of the leg 151 is offset into the channel to form a U-shaped downwardly and outwardly sloping indent 156 to rigidify the upper end of the leg and to provide a wedge surface 158.

The lower end of the leg is formed similar to that shown in FIG. 7 and with its complementary clamp 69 provides a vertical bore for the spindle of the caster wheel.

The brace 160 in this form is channel shaped and comprises a pair of side walls or flanges 162,163 and a transverse wall 164. The webs 162,163 are pivotally connected by a pin 165, it being understood that in each embodiment the term pin includes a bolt and nut assembly or rivet or the like. The wall 164 of the brace is brought to bear against the opposing wall 155. A projection 166 is formed as an offset in the upper end of the wall 164 which mates with the depression or indent 156 and is shaped to wedgingly engage the sloping surface 158. A nut and bolt assembly 168 secures and draws the walls 155, 164 together and simultaneously wedges the projection against the wedge surface and thereby holding the brace and leg in tight engagement with each other while the upper edges 167,167' of the leg and brace abut against the underside of the web 26 of the leg mounting beam. The upper edges of the side webs 162,163 are cut out adjacent to wall 164 to provide clearance and to preclude binding. Also as in all of the embodiments the corners are rounded to accommodate pivotal movement of the parts as will be readily noted by those skilled in the art. A locator tab 168' is formed on the lower end of the brace and enters an opening 169 in the web 155 as best seen in FIG. 15.

In order to fold this leg assembly into the pocket 35, the nut and bolt assembly 168 is disconnected and is loosely attached only to web 164 as seen in FIG. 18 and both the leg and brace are swung away from each other into the pocket 35 to a horizontal position with the free edges of the side walls or flanges of the leg and brace abutting against the underside of the web 26 as at 167, 167'.

A retainer clip 175 is underposed with respect to the leg and brace in engagement with the now horizontally disposed webs 155,164 which are generally parallel with the wall 26 of the leg support beam 25. A wing bolt 170 is extended through opening 171 in the clip and threaded into an opening 173 in the top web 26 of the beam 25. To set up the leg 151 in upright position, the bolt 171 is removed to allow the leg and brace to swing down whereupon they are interconnected at their abutting webs as seen in FIG. 15. In this embodiment the caster may remain attached when the leg is folded or extended. Bolt 168 is used to connect walls 155 and 164.

DESCRIPTION OF FIGS. 20–23

In this embodiment as in the others, parts which are the same are identified by the same numbers.

The leg **37*a* is essentially the same as leg 36 in the first modification, as seen in FIG. 2. The diagonal brace or strut 250 comprises a channel member having a pair of side webs 252,254 interconnected by a transverse web 255. The lower end of the strut 250 is provided with a downwardly extending tab 256 formed as an extension of web 255 and the tab 256 is releasably connected to the web 41 of the leg 37*a* by a nut and bolt assembly 258 passing through aligned openings 259,260 which are provided in the tab 256 and wall 41, the head 262 of the bolt abutting the internal side of the tab and the wing nut 264 being threaded on the shank 265 and bearing against the external side of the leg web 41. The upper end of the brace is inserted into the pocket 35 and is pivotally connected to the side webs 30,31 by a nut and bolt assembly 267 of the leg support beam 25**.

To fold the leg assembly of this embodiment, the nut and bolt assembly 258 is disassembled from leg **37*a* and the leg and brace are swung into the pocket 35, the lower end of the leg 37*a* overlapping the adjacent end portion 269 as seen in FIG. 22. A bolt 270 is passed through opening 260 and threaded through a threaded opening 271 in the top web of the beam 25, the wing nut 272 of bolt 270 bearing against the external side of the transverse web 41 of leg 37*a*. To set up, the bolt 270 is removed and the parts assembled as shown in FIG. 20. The upper end of the leg 37*a* is secured to the beam 25 by a bolt 272**.

I claim:

1. In a bed structure comprising a frame having leg-mounting means (25), a leg assembly (36), stabilizing means (52) extending between said leg assembly and said leg-mounting means (25) for holding said leg assembly in upright position, means (54,55) for securing said stabilizing means to said leg assembly and to said leg-mounting means, disconnectible means **(52*h*) for holding said stabilizing means in stabilizing position and upon disconnection accommodating movement thereof with the leg assembly to a folded position into said leg-mounting means, and a securing bolt (61) threadable into said leg mounting means for releasably securing said leg assembly and stabilizing means in folded position to said leg-mounting (25)** means within the same.

2. The invention according to claim 1 and said stabilizing means comprising:

a pair of pivotally interconnected members overlapped at adjacent ends and thereat connected by said disconnectible means and pivotally connected at their remote ends by said securing means to said leg assembly and said leg-mounting means.

3. The invention according to claim 1 wherein said leg assembly comprises a leg member disposable vertically in supporting position and said stabilizing means comprises at least one element extending diagonally between said leg member and said leg-mounting means.

4. The invention according to claim 2 and said interconnected members and leg assembly being disposed in imbricated relation in said folded position within said leg-mounting means.

5. In a bed structure comprising a frame having leg-mounting means, a leg assembly and stabilizing means extending between said leg assembly and said leg-mounting means for holding said leg assembly in upright position, means for securing said stabilizing means to said leg assembly and to said leg-mounting means, disconnectible means for holding said stabilizing means in stabilizing position and upon disconnection accommodating movement thereof with the leg assembly to a folded position into said leg-mounting means, means for releasably securing said leg assembly and stabilizing means in folded position to said leg-mounting means within the same, said stabilizing means comprising:

a pair of pivotally interconnected members overlapped at adjacent ends and thereat connected by said disconnectible means and pivotally connected at their remote ends by said securing means to said leg assembly and said leg-mounting means, said interconnected members and leg assembly being disposed in imbricated relation in said folded position within said leg mounting means, said means for securing said leg assembly in the folded position to said leg-mounting means, comprising a securing bolt extending through one of said members and threaded into said leg-mounting means.

6. A metal bed frame having side rails and parallel intervening cross-members and leg-mounting beam members, and leg assemblies swingably mounted to said leg-mounting beam members for disposition in upright frame-supporting position and foldable to storage position into said leg-mounting beam members, said leg-mounting beams each comprising an inverted channel having a top web and a pair of side webs with outturned flanges for rigidifying the channel agains lateral deflection, each said leg assembly comprising a leg member extending into said channel and having a pair of side walls in close sliding fit with respective webs for transmitting lateral loads therebetween, and said walls of the leg member having load bearing edges seated against the interior side of said top wall in the upright position of the leg.

* * * * *